US005829808A

United States Patent [19]

Colla

[11] Patent Number: 5,829,808

[45] Date of Patent: Nov. 3, 1998

[54] ADJUSTABLE ANGLE SNOW SHOVEL

[76] Inventor: Dan Colla, 6261 N. Keating, Chicago, Ill. 60646

[21] Appl. No.: 905,268

[22] Filed: Aug. 6, 1997

[51] Int. Cl.[6] ..... E01H 5/02

[52] U.S. Cl. ..... 294/53.5; 294/54.5

[58] Field of Search ..... 294/49, 51, 53.5, 294/54.5; 172/372, 375; 37/265, 284, 285; 56/400.19

[56] References Cited

U.S. PATENT DOCUMENTS

| | | | |
|---|---|---|---|
| 813,983 | 2/1906 | Luney | 294/54.5 |
| 1,127,015 | 2/1915 | Keeler | 172/375 |
| 1,667,591 | 4/1928 | Eden | 294/54.5 |
| 1,693,472 | 11/1928 | Batty | 37/284 |
| 2,243,127 | 5/1941 | Roseman | 172/375 |
| 2,463,150 | 3/1949 | Camp | 294/51 |
| 2,919,153 | 12/1959 | Benton | 294/51 |
| 3,248,811 | 5/1966 | Pravednekow | 294/51 |
| 3,797,581 | 3/1974 | Holloway | 172/375 |
| 4,264,095 | 4/1981 | Lemasters | 294/53.5 |
| 4,538,847 | 9/1985 | Lapshansky | 294/51 |
| 4,559,726 | 12/1985 | Molsam | 294/51 |

FOREIGN PATENT DOCUMENTS

| | | | |
|---|---|---|---|
| 170697 | 3/1960 | Sweden | 294/53.5 |

*Primary Examiner*—Dean Kramer
*Attorney, Agent, or Firm*—Patent & Trademark Services Joseph H. McGlynn

[57] ABSTRACT

An adjustable handle for a shovel such as a snow shovel which has an arcuate slot which cooperates with a fastener on the handle to allow the handle to be adjusted from side to side. A reinforcement is secured to the back of the shovel and surrounds the arcuate slot.

4 Claims, 1 Drawing Sheet

ADJUSTABLE ANGLE SNOW SHOVEL

BACKGROUND OF THE INVENTION

This invention relates, in general, to shovels, and, in particular, to a snow shovel which has an adjustable handle.

DESCRIPTION OF THE PRIOR ART

In the prior art various types of shovels have been proposed For example, U.S. Pat. No. 2,463,150 discloses a snow shovel having a means for adjusting the handle with respect to the blade which comprises a pivoted handle which can be moved from side to side and, in addition, the handle can be moved toward and away from the blade.

U.S. Pat. No. 2,919,153 discloses a snow shovel with a handle that can be moved side to side and can be moved away from the blade and locked in three positions.

U.S. Pat. No. 3,248,811 discloses a snow shovel with a pivoting handle which is telescoping and spring biased.

U.S. Pat. No. 4,538,847 discloses a snow shovel which has two sockets into which the handle may be placed in order to angle the handle.

SUMMARY OF THE INVENTION

The present invention comprises an adjustable handle for a shovel such as a snow shovel which has an arcuate slot which cooperates with a fastener on the handle to allow the handle to be adjusted from side to side.

It is an object of the present invention to provide a new and improved shovel handle which allows the handle to be moved from side to side.

It is an object of the present invention to provide a new and improved shovel handle which allows infinite adjustment side to side of the handle.

These and other objects and advantages of the present invention will be fully apparent from the following description, when taken in connection with the annexed drawings.

DESCRIPTION OF THE PREFERRED EMBODIMENT

Figure 1:
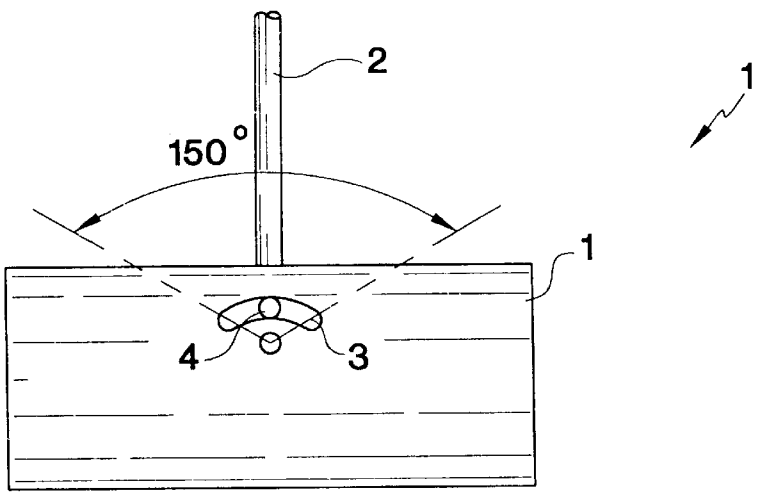
FIG. 1 is a front view of the shovel of the present invention.

Referring now to the drawings in greater detail, FIG. 1 shows a shovel 1 which embodies the present invention. It should be noted that the shovel shown in FIG. 1 is a snow shovel, however, the present invention could be used with other types of shovels. The shovel 1 has an arcuate slot 3 which extends completely through the shovel (see also FIG. 2 which shows the slot extending through to the back of the shovel). Extending through the slot 3 is a headed fastener 4. The headed fastener has a head which is larger than the width of the slot 3 so the fastener can not come through the slot. Also, the slot 3 has an extend that allows the headed fastener to move approximately 150° as shown in FIG. 1.

Figure 2:
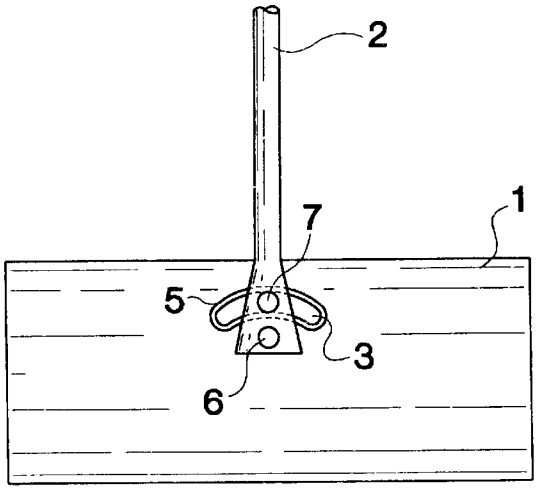
FIG. 2 is a back view of the shovel of the present invention.

As shown in FIG. 2 the handle 2 is attached at a pivot point 6 to the back of the shovel 1. The pivot means which attaches the handle 2 to the shovel at this point can be any conventional fastener such as, but not limited to, a rivet, which will allow the handle 2 to pivot about the pivot point 6. The slot 3 can have a reinforcing portion 5 attached to the back of the shovel to prevent wearing of the back of the shovel. The reinforcing portion 5 should be a metal or heavy duty plastic which will protect the back of the shovel 1 as the handle is moved from one side of the slot 3 to the other side of the slot.

A fastener 7 extends through the handle 2, the slot 3 and cooperates with the headed fastener 4 on the front of the shovel to allow the handle to be moved from one side to the other of slot 3. Any conventional fasteners can be used to secure the handle in its various adjusted positions. For example, the fastener 4 could be a headed bolt and the fastener 7 could be a nut or wing nut. Of course these are merely examples, and any type of fasteners which can be loosened to allow the handle to be rotate and then secured to firmly hold the handle in the new position can be used.

Figure 3:
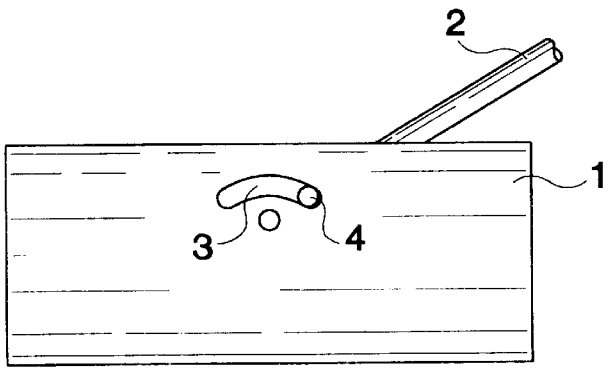
FIG. 3 is a front view of the present invention with the handle in one of the adjusted positions.

As seen in FIG. 3 when the handle 2 is moved into the far right position (as seen in the Figure), the fasteners 4, 7 can be used to secure the handle in this position. All that is necessary to move the handle to a new position, is to loosen the fasteners, move the handle to a selected new position and then tighten the fasteners.

In use, the person who is using the shovel can use it like an ordinary shovel or plow by placing the handle 2 in the center position. However, if the user wants to move snow to either the left or the right side, he/she can loosen the fasteners 4, 7 move the handle 2 either to the left or the right and the tighten the fasteners 4, 7 to hold the handle in the new position. Now the shovel will automatically move the snow in the direction dictated by the new position of the handle. This will allow the user to easily move snow without lifting the shovel or twisting his/her body.

In addition, since the slot 3 has no indentations to fix the handle in a position selected by the manufacture, the handle can be moved to any position from one end of the slot 3 to the other end of the slot. Therefore, the user can select the position that is most advantageous to use depending on the volume and direction he/she wants to move the snow. This infinite adjustment between one end of the slot 3 and the other end makes the adjustable handle more convenient than the prior art devices which force the user to use the positions that the manufacturer has decided are the desired positions.

Although the Adjustable Angle Shovel and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An adjustable shovel comprising:

a generally planar blade portion, said blade portion having a curved slot extending therethrough, said slot having a first end and a second end, said slot being continuous without any interruptions between said first and second ends, said shovel also having a handle, said handle being pivotally connected to a back of said blade portion, a fastener means extending through said handle and said slot for securing said handle in one of a plurality of positions between said first and second ends of said slot, and wherein said blade portion has a reinforcing means secured to said back of said blade portion, said reinforcing means surrounding only said slot.

2. The adjustable shovel as claimed in claim 1, and wherein said reinforcing means is attached only to a periphery of said slot.

3. The adjustable shovel as claimed in claim 1, and wherein said reinforcing means is made from metal.

4. The adjustable shovel as claimed in claim 1, and wherein said reinforcing means is made from heavy duty plastic.

* * * * *